US007524165B2

(12) United States Patent
Bourgoin et al.

(10) Patent No.: US 7,524,165 B2
(45) Date of Patent: Apr. 28, 2009

(54) CONTROL LEVER FOR THE ANGULAR SETTING OF A STATOR BLADE IN A TURBOSHAFT ENGINE

(75) Inventors: Sebastien Bourgoin, Paris (FR); Christophe Follonier, Saint Fargeau Ponthierry (FR); Claude Robert Louis Lejars, Draveil (FR); Christophe Yvon Gabriel Tourne, Varennes Jarcy (FR); Bruce Daniel Jean Pontoizeau, Paris (FR); Nicolas Christian Triconnet, Saint Fargeau Pontheirry (FR)

(73) Assignee: SNECMA, Paris (FR)

( * ) Notice: Subject to any disclaimer, the term of this patent is extended or adjusted under 35 U.S.C. 154(b) by 494 days.

(21) Appl. No.: 11/227,484

(22) Filed: Sep. 16, 2005

(65) Prior Publication Data

US 2006/0062667 A1 Mar. 23, 2006

(30) Foreign Application Priority Data

Sep. 21, 2004 (FR) ..... 04 09945

(51) Int. Cl.
*F04D 29/46* (2006.01)

(52) U.S. Cl. ..... 415/160; 415/162

(58) Field of Classification Search ..... 415/160, 415/159, 156, 148, 162
See application file for complete search history.

(56) References Cited

U.S. PATENT DOCUMENTS

| | | | | |
|---|---|---|---|---|
| 4,652,208 | A | 3/1987 | Tameo | |
| 4,979,874 | A * | 12/1990 | Myers | 415/160 |
| 5,492,446 | A | 2/1996 | Hawkins et al. | |
| 6,019,574 | A * | 2/2000 | DiBella | 415/160 |
| 6,146,093 | A * | 11/2000 | Lammas et al. | 415/160 |
| 6,422,818 | B2 * | 7/2002 | Mashey | 416/96 R |
| 2005/0106010 | A1 * | 5/2005 | Evans | 415/160 |

FOREIGN PATENT DOCUMENTS

| | | |
|---|---|---|
| EP | 1 431 520 | 6/2004 |

* cited by examiner

*Primary Examiner*—Edward Look
*Assistant Examiner*—Dwayne J White
(74) *Attorney, Agent, or Firm*—Oblon, Spivak, McClelland, Maier & Neustadt, P.C.

(57) ABSTRACT

Control lever for the angular setting of a stator blade, comprising a first end intended to be fitted in a fixed manner on a blade pivot, a second end comprising a cylindrical pin for fitting on a control ring, and a flat intermediate part connecting the first and second ends having shapes and dimensions determined in order to increase the natural frequencies of the lever in flexion and in torsion above the vibratory frequencies of the turboshaft engine upstream of the lever and in order to retain the stiffness of the lever.

12 Claims, 1 Drawing Sheet

CONTROL LEVER FOR THE ANGULAR SETTING OF A STATOR BLADE IN A TURBOSHAFT ENGINE

The present invention relates to a control lever for the angular setting of a stator blade in a turboshaft engine and a turboshaft engine compressor comprising a plurality of variable setting angle stator blades equipped with these control levers.

BACKGROUND OF THE INVENTION

The adjustment of the angular setting of the stator blades in a turboshaft engine such as a turbojet is intended to optimize the efficiency of this turboshaft engine and to reduce its consumption of fuel in the different flight configurations.

This adjustment is carried out by means of a lever which comprises a first end fitted in a fixed manner on a pivot of the blade in order to drive it in rotation about its longitudinal axis, a second end comprising a cylindrical pin for fitting on a control ring which surrounds the stator of the turboshaft engine externally and which is movable in rotation about the longitudinal axis of the stator by a drive means such as a jack or an electric motor, and a flat intermediate part connecting the first and second ends of the lever.

The control lever which is driven in rotation by the control ring and which is fixed to the pivot of the blade, is subjected to flexion and torsion forces which are applied principally to its intermediate part and its second end.

During the functioning of the turboshaft engine, these control levers are subjected to vibrations due, in particular, to the passages of the rotor blades in front of the stator blades, the frequencies of these vibrations varying with the speed of rotation of the rotor.

It has been observed that these frequencies could coincide with a vibratory mode of said levers, and that the resultant stresses undergone by the levers could cause the appearance of splits or cracks in these levers, particularly in the zone connecting their intermediate part with their second end connected to the control ring, with a risk of fracture of the levers.

One solution making it possible to avoid this serious disadvantage would consist in over-sizing each lever in order to avoid any appearance of splits of cracks and therefore to avoid any risk of fracture of the lever. However, this would result in correspondingly increasing the stiffness of the lever and the power necessary to move the lever since any displacement of the lever results in a deformation of the lever in flexion and in torsion. As the energy consumed by the actuation of the levers is taken from the energy provided by the turboshaft engine, such a solution would be very disadvantageous.

SUMMARY OF THE INVENTION

The purpose of the present invention is to avoid the appearance of splits or cracks in a lever of the aforementioned type, without substantially modifying the stiffness of that lever.

For this purpose it proposes a lever for the control of the angular setting of a stator blade, in particular in a turboshaft engine compressor, comprising a first end intended to be fitted in a fixed manner on a blade pivot, a second end comprising a cylindrical pin for fitting on a drive means and a flat intermediate part connecting the first and second ends, said first end having a thickness and a width greater than those of the intermediate part and of the second end of the lever, wherein the shapes and dimensions of the intermediate part and of the second end are determined in order to increase the natural frequencies of the lever in flexion and in torsion above the vibratory frequencies of the turboshaft engine upstream of the lever and in order to retain the stiffness of the lever.

Increasing the natural frequencies of the lever in flexion and in torsion above the vibratory frequencies of the turboshaft engine upstream of the lever prevents the lever from being able to go into resonance during the functioning of the turboshaft engine and, by retaining its stiffness, the power necessary for its actuation is not increased and the functioning of the turboshaft engine is not degraded.

In this way any risk of the appearance of splits or cracks in the control lever due to vibratory fatigue is avoided.

In a preferred embodiment of the invention, the second end of the control lever has a thickness greater than that of the intermediate part, and the intermediate part locally has a width less than that of the second end of the lever.

Increasing the thickness of the second end of the control lever makes it possible to withstand the stresses better during the crimping of the cylindrical pin, and to limit the appearance and propagation of splits or cracks. It results in an increase in the overall stiffness of the lever, which is compensated for by a local reduction in the width of the intermediate part such that the control lever retains the same stiffness and requires the same actuating power as before.

In this embodiment, the intermediate part of the lever is of constant thickness and is connected to the ends of the lever by zones of progressively increasing thickness.

The progressive increase in thickness of the zones of connection to the ends of the lever makes it possible to reduce the local concentrations of stresses.

The intermediate part of the lever has incurved longitudinal edges of concave shape which allow progressive transitions between portions of different widths whilst avoiding the concentrations of stresses that would appear in parts of the lever if their widths were to vary suddenly and discontinuously.

The shape and dimensions of the control lever are therefore optimized dynamically in order to increase the natural frequencies of the lever in flexion and in torsion above the vibratory frequencies of the turboshaft engine upstream, and statically by reducing the local concentrations of stresses.

Moreover, the control lever according to the invention is advantageously subjected, at least partially, to shot peening, this treatment making it possible to harden the surface of the lever and thus to protect it from possible shocks or blows during its handling and its fitting on the blade pivot and on the control ring, these shocks and blows being able to be the cause of splits or microcracks.

The invention also proposes a turboshaft engine compressor, for example that of a turbojet, comprising a plurality of variable setting blades equipped with control levers of the aforementioned type.

BRIEF DESCRIPTION OF THE DRAWINGS

Other advantages and features of the invention will become apparent on reading the following description given as a non-limiting example with reference to the appended drawings in which.

DESCRIPTION OF THE PREFERRED EMBODIMENT

Figure 1:
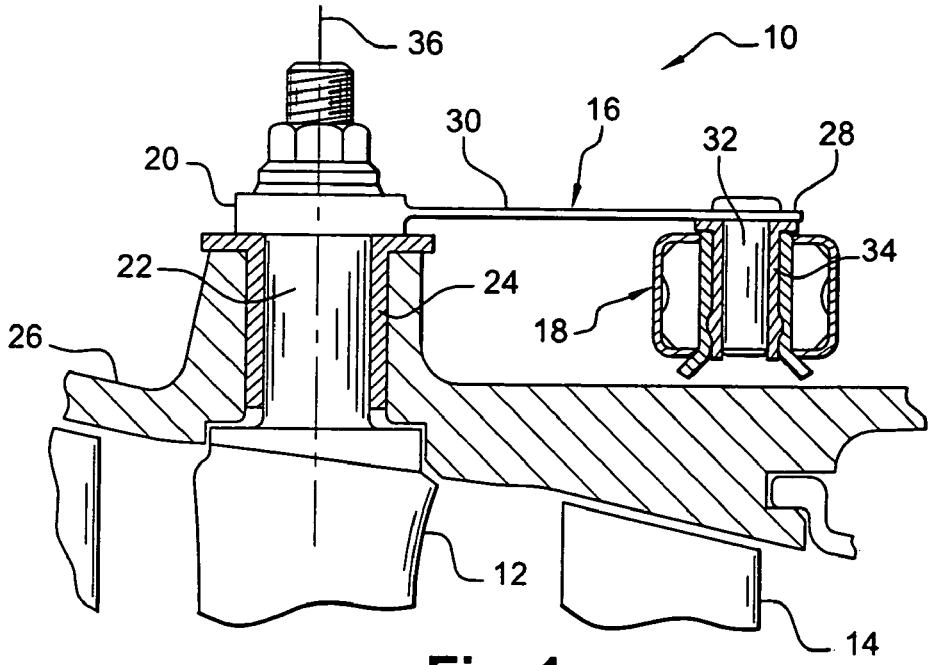
FIG. 1 is a diagrammatic view in partial cross section of a lever for controlling the angular setting of a stator blade in a compressor stage of a turboshaft engine.

FIG. 1 shows a part of a high-pressure compressor 10 of a turboshaft engine, in which each stage of the compressor comprises a row of guide vane blades 12 fitted on the stator and a row of blades 14 carried by the rotor.

The blades 12 of the stator are downstream guide vane blades whose orientation or angular setting is adjustable using control levers 16 driven by a control ring 18 actuated by drive means (not shown) of the jack or electric motor type.

Each control lever 16 comprises a first end 20 fixed to a radial pivot 22 of a blade 12, guided in rotation in a bearing 24, mounted in a radial shaft of an external casing 26, a second end 28 and a flat intermediate part 30 connecting the ends 20 and 28.

The second end 28 of the control lever 16 carries a cylindrical pin 32 which is crimped on this end 28 and is guided in rotation in a cylindrical socket 34 of the control ring 18.

An angular displacement of the control ring 18 about the axis of the casing 26 results in a rotation of the levers 16 about the axes 36 of the pivots 22 and in the driving in rotation of the blades 12 about these axes 36, and in deformations in flexion and in torsion of the levers 16.

Figure 2:
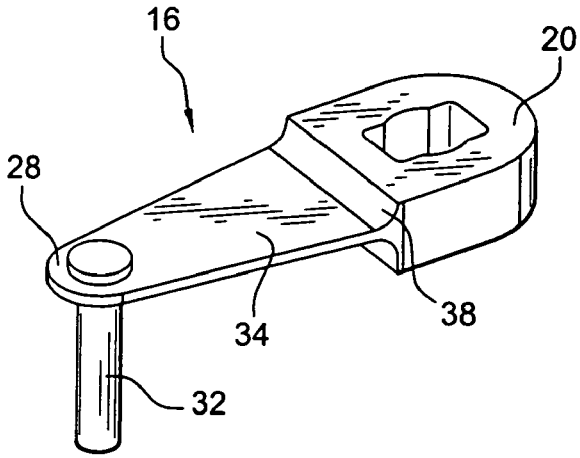
FIG. 2 is a diagrammatic view in perspective of a control lever according to the prior art.

As can be seen better in FIG. 2, the first end 20 of the lever 16 has a thickness and a width greater than those of the intermediate part 34 and of the second end 28 of the lever 16. For example, the thickness of the first end 20 is about 10 mm and its width is about 22 mm.

The second end 28 of the lever 16 which carries the cylindrical pin 32 for fitting on the control ring 18 has a circular edge extending over about 180° around the crimped head of the cylindrical pin 32. For example, the thickness of the second end is about 1.1 mm and its width is about 10 mm.

The intermediate part 34 which connects the first and second ends 20 and 28 has the same thickness as the second end 28 and a triangular shape and is connected to the first end 20 by a connecting zone 38 of progressively increasing thickness. For example, the thickness of the intermediate part 34 is about 1.1 mm and its width varies between about 10 and 22 mm.

During the functioning of the high pressure compressor, the natural frequencies of the levers 16 in flexion and in torsion can coincide with the vibratory frequencies of the upstream part of the compressor and therefore provoke large vibrations in the levers 16, resulting in the formation of splits or cracks, particularly in the zones of crimping of the cylindrical pins 32 to the second ends 28 of the levers 16. This vibratory frequency depends on the speed of rotation of the rotor and is about 6500 Hz for a particular example of the high pressure compressor in question.

According to the invention, the shapes and dimensions of the intermediate part 34 and of the second end 28 are modified so that the natural frequencies of the lever 16 in flexion and in torsion are higher that the vibratory frequencies of the upstream part of the compressor, without substantially increasing the stiffness of the lever.

Figure 3:
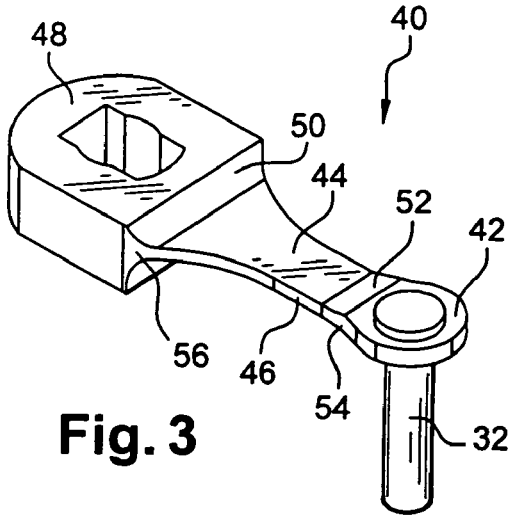
FIG. 3 is a diagrammatic view in perspective of a control lever according to the invention.

FIG. 3 is a diagrammatic view in perspective of one embodiment of a control lever 40 according to the invention.

The second end 42 of the lever 40 has a thickness greater than that of the second end 28 of the lever 16 of the prior art in order to better withstand the stresses due to the crimping of the cylindrical pin 32 and to delay the propagation of splits or cracks. This thickness is, for example, about 1.8 mm.

The shape of the second end 42 has also been modified by increasing the angular extent of its rounded edge which extends over more than 180°. This rounded edge can have one or more radii of curvature varying, for example, between 6 and 15 mm.

The intermediate part 44 of the lever 40 is of constant thickness, greater than that of the intermediate part 34 of the lever 16 of the prior art but less that that of the second end 42 of the lever 40. For example, the thickness of the intermediate part 44 of the lever 40 is about 1.4 mm.

The increase in stiffness of the lever 40 due to the increase in the thickness of the intermediate part 44 and of the second end 42 is compensated for by a reduction in the width of at least a portion 46 of the intermediate part 44 of the lever 40, which makes it possible to retain the same overall stiffness as in the prior art, this portion 46 being connected to the second end 42 of the lever.

In the exemplary embodiment shown in FIG. 3, the portion 46 has a width of about 8 mm, less than that of the second end 42, and is delimited by the substantially parallel longitudinal edges.

The intermediate part 44 of the lever 40 is connected to the first end 48 by a connecting zone 50 of short length and of progressively increasing thickness which is essentially identical to that of the connecting zone 38 of the lever 16 of the prior art and whose thickness varies between that of the intermediate part 44 of the lever 40 and that of its first end 48.

Another zone 52 of progressively increasing thickness connects the portion 46 of the intermediate part 44 to the second end 42 of the lever 40.

The edges 54, 56 of the connecting zones 50 and 52 and of the intermediate part 44 are incurved and concave and connected to the straight edges of said portion 46. The edges 54 can have one or more radii of curvature which are typically between 6 and 15 mm, for example, and the edges 56 can also have one or more radii of curvature which are typically between 15 and 30 mm, for example. The radii of curvature of the edges 54, 56 therefore increase from the second end 42 of the lever 40 towards the first end 48.

The control lever 40 according to the invention is preferably treated at least partially by shot peening, for example over the intermediate part 44 and/or over the second end 42 of the lever 40. This treatment makes it possible to harden the surface of the lever and therefore to improve its protection against shocks or blows which can occur, in particular, during the fitting of the control lever 40 and which can cause the beginnings of splits or of cracks.

The control lever 40 according to the invention is advantageously made of titanium.

The invention claimed is:

1. A lever for the control of the angular setting of a stator blade in a turboshaft engine, said lever comprising:

a first end to be fitted in a fixed manner on a blade pivot, a second end comprising a cylindrical pin for fitting on a drive means, and a flat intermediate part connecting the first and second ends, wherein said first end has a thickness and a width greater than those of the intermediate part and of the second end of the lever, wherein the second end has a thickness greater than that of the intermediate part, and the intermediate part locally has a width less than that of the second end of the lever, wherein the portion of less width of the intermediate part is that connecting the intermediate part to the second end, wherein the intermediate part is of constant thickness and is connected to the ends of the lever by zones of progressively increasing thickness, and wherein the shapes and dimensions of the intermediate part and of the second end are determined in order to increase the natural frequencies of the lever in flexion and in torsion above the vibratory frequencies of the turboshaft engine upstream of the lever and in order to retain the stiffness of the lever.

2. A lever according to claim 1, wherein said intermediate part has incurved longitudinal edges of concave shape.

3. A lever according to claim 2, wherein the radii of curvature of the edges of the intermediate part increase from the second end of the lever towards the first end.

4. A lever according to claim 1, wherein said lever is treated, at least partially, by shot peening.

5. A lever according to claim 1, wherein said lever is made of titanium.

6. A turboshaft engine compressor comprising a plurality of variable setting angle blades, wherein each variable setting blade is equipped with a control lever according to claim 1.

7. A lever according to claim 1, wherein said intermediate part has incurved longitudinal edges of concave shape.

8. A lever for the control of the angular setting of a stator blade in a turboshaft engine, said lever comprising:

a first end to be fitted in a fixed manner on a blade pivot, a second end comprising a cylindrical pin for fitting on a drive means, and a flat intermediate part connecting the first and second ends, wherein said first end has a thickness and a width greater than those of the intermediate part and of the second end of the lever, wherein said intermediate part has a first portion with a width greater than that of the second end of the lever, and said intermediate part has a second portion with a width less than that of the second end of the lever, and wherein the shapes and dimensions of the intermediate part and of the second end are determined in order to increase the natural frequencies of the lever in flexion and in torsion above the vibratory frequencies of the turboshaft engine upstream of the lever and in order to retain the stiffness of the lever.

9. A lever according to claim 8, wherein said first portion is connected to said first end of the lever, and said second portion is connected to said second end of the lever.

10. A lever according to claim 9, wherein said first portion is connected to said first end of the lever by a first zone of progressively increasing thickness, and said second portion is connected to said second end of the lever by a second zone of progressively increasing thickness.

11. A lever according to claim 10, wherein said the first end of the lever has a width greater than that of said second end of the lever.

12. A lever according to claim 10, wherein said lever has a stiffness that is substantially equal to that of another lever, said another lever including said first end and said pin but including another second end and another intermediate part connecting said first end to said another second end, said another second end having a thickness equal to that of said another intermediate part, and wherein said another intermediate part has a width that progressively decreases from said first end to said another second end, and wherein said another second end has a width that is smaller than any portion of said intermediate part.

* * * * *